US007962086B2

(12) United States Patent
Kato

(10) Patent No.: US 7,962,086 B2
(45) Date of Patent: Jun. 14, 2011

(54) CLEANING DEVICE, PROCESS CARTRIDGE, AND IMAGE FORMING APPARATUS

(75) Inventor: Masahiko Kato, Yokohama (JP)

(73) Assignee: Ricoh Company Ltd., Tokyo (JP)

( * ) Notice: Subject to any disclaimer, the term of this patent is extended or adjusted under 35 U.S.C. 154(b) by 244 days.

(21) Appl. No.: 12/230,295

(22) Filed: Aug. 27, 2008

(65) Prior Publication Data

US 2009/0060601 A1 Mar. 5, 2009

(30) Foreign Application Priority Data

Sep. 5, 2007 (JP) ..... 2007-230417

(51) Int. Cl.
*G03G 21/00* (2006.01)

(52) U.S. Cl. ..... 399/351; 399/350

(58) Field of Classification Search ..... 399/350, 399/351, 349, 71
See application file for complete search history.

(56) References Cited

U.S. PATENT DOCUMENTS 4,304,026 A * 12/1981 Borostyan ..... 399/351

FOREIGN PATENT DOCUMENTS

| | | | |
|---|---|---|---|
| JP | 05-142887 | | 6/1993 |
| JP | 2671792 | | 7/1997 |
| JP | 06-051673 | | 2/1999 |
| JP | 3097926 | | 8/2000 |
| JP | 2003043881 | A * | 2/2003 |
| JP | 2007328272 | A * | 12/2007 |

OTHER PUBLICATIONS

English language Abstract of JP 05-066782 dated Mar. 19, 1993.
English language Abstract of JP 07-199731 dated Aug. 4, 1995.

* cited by examiner

*Primary Examiner* — Susan S Lee
(74) *Attorney, Agent, or Firm* — Harness, Dickey & Pierce, PLC

(57) ABSTRACT

A cleaning device includes a blade member, a holder, a vibration detection device, a heating device, and a control device. The blade member comes into contact with an image carrying member, and cleans off toner remaining on the image carrying member. The holder holds the blade member. The vibration detection device detects the vibration level of either one of the blade member and the holder. The heating device heats either one of the blade member and the holder. The control device controls the heating device to heat either one of the blade member and the holder when the vibration level detected by the vibration detection device exceeds a predetermined threshold value.

8 Claims, 5 Drawing Sheets

CLEANING DEVICE, PROCESS CARTRIDGE, AND IMAGE FORMING APPARATUS

BACKGROUND OF THE INVENTION

1. Field of the Invention

The present invention relates to a cleaning device used in an electrophotographic copier, facsimile machine, printer, or the like, particularly to a cleaning device which reduces noise occurring between a cleaning blade and a photoconductor and improves the cleaning performance, and a process cartridge and an image forming apparatus each including the cleaning device.

2. Description of the Related Art

Most of measures for preventing noise occurring in an image forming apparatus such as a copier and a printer have been passive measures using a sound absorbing material or a sound insulating material. Meanwhile, the concept of active noise control of intentionally emitting sound of the reverse phase to the phase of noise to interfere with and cancel the noise has existed for a long time. However, the practical application of the active noise control had not been attained due to the need for an advanced technology.

It is only in recent years that the active noise control has been practically applied along with developments such as the advancement in the signal processing technology. Well-known techniques of the active noise control have been applied to a refrigerator, a vehicle, and so forth. The techniques are for emitting sound of the reserve phase to the phase of noise through a speaker or the like to interfere with and cancel the noise.

In an example according to a background technique, the active noise control method is applied to a vehicle and so forth. Further, in an example according to another background technique, the active noise control method is applied to a copier. According to the background techniques, sound of the reserve phase to the phase of noise is emitted through a speaker or the like to interfere with and cancel the noise. As in such background techniques, sound deadening devices according to the passive noise control method and sound deadening devices according to the active noise control method have been effectively used to prevent noise generated by office automation equipment and so forth from leaking outside the equipment. Further, to reduce noise caused by a charging process, according to another background technique, a dynamic damper is provided to a photoconductor drum, which is a member applied with vibration, to reduce the vibration of the drum and thereby reduce resultant noise.

Meanwhile, in a photoconductor unit and so forth of an image forming apparatus, stick-slip occurs due to the friction generated between a cleaning blade and a photoconductor. Further, vibration resulting from the stick-slip acts as a vibration source to generate high-pitched noise from the photoconductor, or is propagated from the cleaning blade to a unit housing to generate noise. A cleaning device is indispensable to remove residual toner. Thus, the reduction of the noise is desired. The vibration source causing the noise is the stick-slip. The vibration mode of the stick-slip is the self-excited vibration. The occurrence or non-occurrence of the self-excited vibration mode is highly unstable, i.e., the self-excited vibration mode is an unstable mode in fixed value analysis. The unstable mode varies depending on the contact sliding state between the cleaning blade and the photoconductor. The unstable mode may occur or may not occur depending on the combination of a variety of conditions, such as the change in the physical property value of the cleaning blade caused by the change in the internal temperature or humidity of the image forming apparatus, the deterioration of the cleaning blade over time, and the adhesion of toner on the photoconductor. Even in the same configuration, therefore, such a phenomenon occurs in which the vibration noise attributed to the stick-slip suddenly occurs one day or the vibration noise occurs or does not occur depending on the environment of the installation location of the cleaning blade.

DESCRIPTION OF THE PREFERRED EMBODIMENTS

Figure 1:
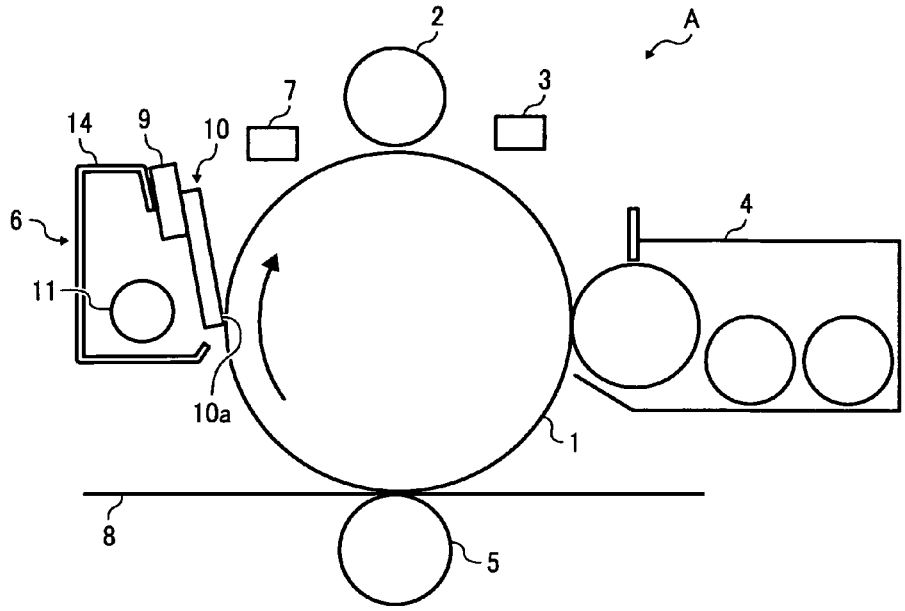
FIG. 1 is a schematic configuration diagram of an image forming apparatus according to an embodiment of the present invention.

Embodiments of the present invention will be described in detail below with reference to the drawings. FIG. 1 is a schematic configuration diagram of an image forming apparatus A according to an embodiment of the present invention. The image forming apparatus A includes an image carrying member 1 which rotates in the direction indicated by an arrow. The image carrying member 1 is surrounded by a charging device 2, an exposure device 3, a development device 4, a transfer device 5, a cleaning device 6, and an electricity removal device 7.

The charging device 2 is disposed apart from a surface of the image carrying member 1 by a predetermined distance to be or not to be in contact with the image carrying member 1. As the charging device 2 is applied with a bias voltage, the image carrying member 1 is charged to a predetermined polarity and a predetermined potential.

Further, the exposure device 3 applies light to the image carrying member 1 on the basis of image data by using an LD (Laser Diode) or LED (Light Emission Diode) as a light-emitting device, to thereby form an electrostatic latent image.

The development device 4 includes a magnet roller fixed therein and a rotatable developer carrying member. The developer carrying member carries a developer thereon. The present embodiment employs two-component magnetic brush development using, as the developer, a two-component developer including toner and carrier. As an alternative development method, a one-component development method not using the carrier may be used. The developer carrying member is applied with a voltage from a development bias voltage power supply. Due to the difference in potential between the development bias voltage and the potential of the electrostatic latent image formed on the surface of the image carrying member 1, the charged toner is adhered to the electrostatic latent image in an development area. Thereby, a development process is performed.

In a transfer process, the transfer device 5 is brought into contact with the surface of the image carrying member 1 by predetermined pressing force, and is applied with a voltage. Thereby, the toner image formed on the surface of the image carrying member 1 is transferred onto a transfer medium 8 at a transfer nip portion formed between the image carrying member 1 and the transfer device 5. In the present embodiment, a transfer roller is used to perform the transfer process. Alternatively, a transfer device such as a corotron and a transfer belt may be used.

The electricity removal device 7 removes residual charge from the image carrying member 1, from which residual toner has been removed by the cleaning device 6, and employs an optical electricity removing method using an LED or the like.

Further, the cleaning device 6 is constituted by a blade member (a cleaning blade) 10, a holder 9 for holding the blade member 10, a case 14 attached with the holder 9, and so forth. As a contact end 10*a* of the blade member 10 is pressed against the image carrying member 1, the residual toner is scraped off and removed from the image carrying member 1.

The toner scraped off from the image carrying member 1 by the blade member 10 is accumulated in the case 14 and stored as waste toner in a not-illustrated waste toner bottle by a toner conveying member 11 provided in the case 14. The stored toner is collected by a serviceman or the like, or is conveyed to the development device 4 and so forth as recycled toner to be used in the development process.

In a cleaning device having the above-described configuration, it is known that the stick-slip occurs between the blade member 10 and the image carrying member (a photoconductor) 1, as described above. The stick-slip causes the blade member 10 and the image carrying member 1 to vibrate and generate acoustic radiation. As a result, noise is generated. Particularly, if the image carrying member 1 sympathetically vibrates, or if the exciting force on the image carrying member 1 is increased due to the sympathetic vibration of the blade member 10, the noise is increased. The vibration mode of the stick-slip is the self-excited vibration. The occurrence or non-occurrence of the self-excited vibration mode is highly unstable, i.e., the self-excited vibration mode is an unstable mode in fixed value analysis. The unstable mode varies depending on the contact sliding state between the blade member 10 and the image carrying member 1. As one of factors for varying the contact sliding state, there is the change in the physical property value of the blade member 10 caused by the change in the internal temperature of the image forming apparatus A. A blade member is formed of a rubber-based material in many cases. This is because the rubber-based material has a characteristic of having a physical property value which tends to significantly change according to the temperature.

Figure 2:
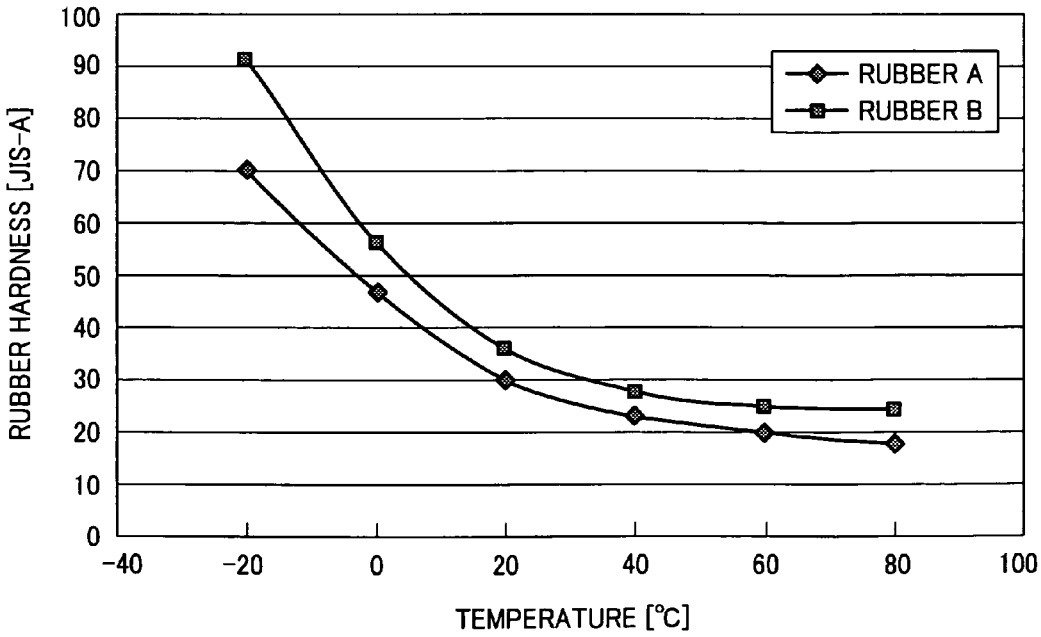
FIG. 2 is a graph illustrating changes in the rubber hardness with respect to the temperature.

FIG. 2 is a graph illustrating changes in the rubber hardness with respect to the temperature. As illustrated in FIG. 2, in the physical property value of rubber-based materials used in a blade member, the hardness is changed according to the temperature. Thus, in accordance with the change in the hardness, the contact state between the blade member 10 and the image carrying member 1 is also changed. Therefore, contrary to the normal operation of the image forming apparatus A, in which the stick-slip does not occur, if the internal temperature of the apparatus is increased due to a long-time continuous operation, the physical property of the blade member 10 is changed to cause a change in the contact sliding state. As a result, the stick-slip occurs to generate a squeak in some cases. Normally, when the blade member 10 is emitting the squeaky noise, the holder 9 and the blade member 10 are significantly vibrating.

Figure 3:
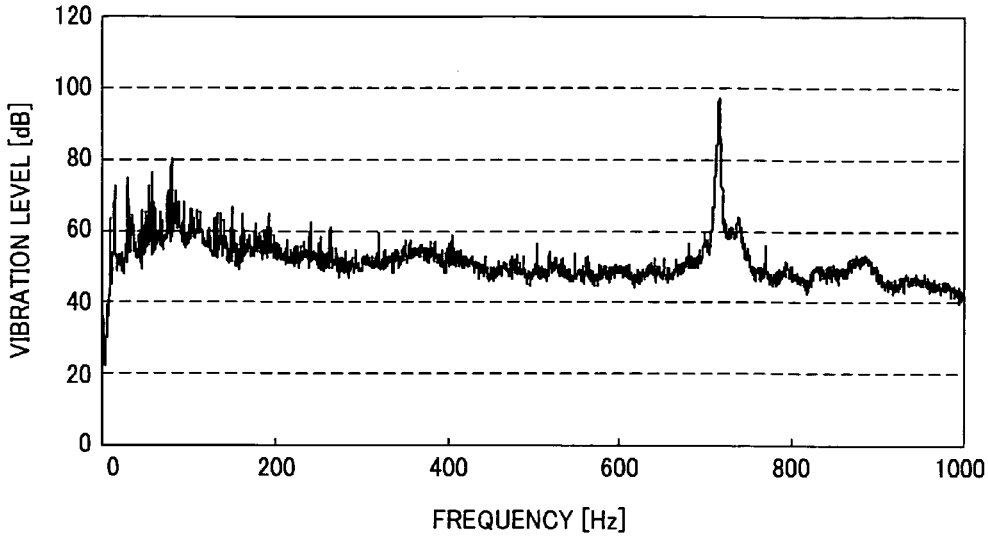
FIG. 3 is a graph illustrating an example of vibration state of a holder measured in a noise-occurring state.

FIG. 3 is a graph illustrating an example of vibration state of the holder 9 measured in a noise-occurring state. As illustrated in FIG. 3, in the noise-occurring state, the vibration attributed to the stick-slip occurs. It is observed that the vibration level reaches the peak thereof particularly when the vibration frequency of the blade member 10 is 715 hertz.

Description will be made below of a configuration according to an embodiment of the present invention for reducing the vibration noise caused by the stick-slip as described above.

Figure 4:
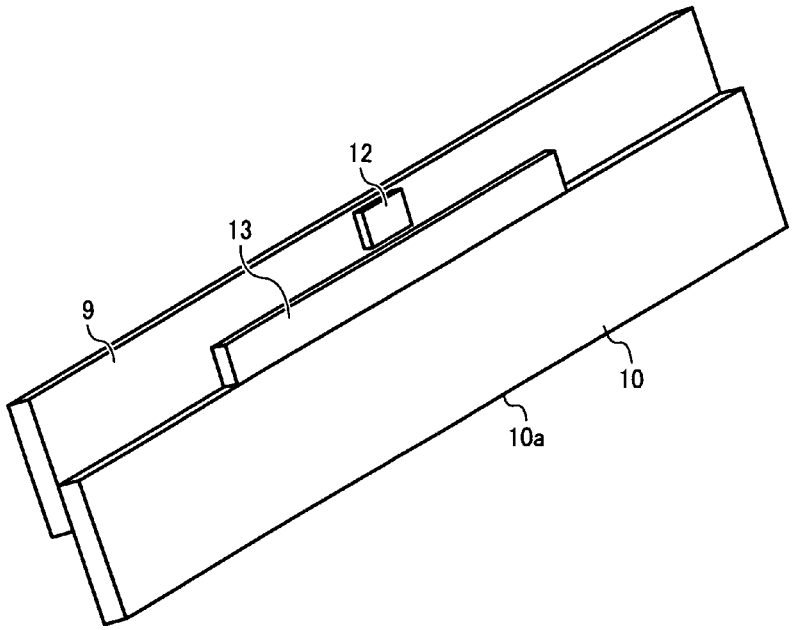
FIG. 4 is a diagram for explaining a configuration example of a cleaning member according to an embodiment of the present invention.

FIG. 4 is a diagram for explaining a configuration example of a cleaning member according to an embodiment of the present invention. In FIG. 4, the holder 9 is provided with a vibration detection device 12 capable of detecting the vibration state of the holder 9 and a heating device 13 for heating the holder 9.

Figure 5:
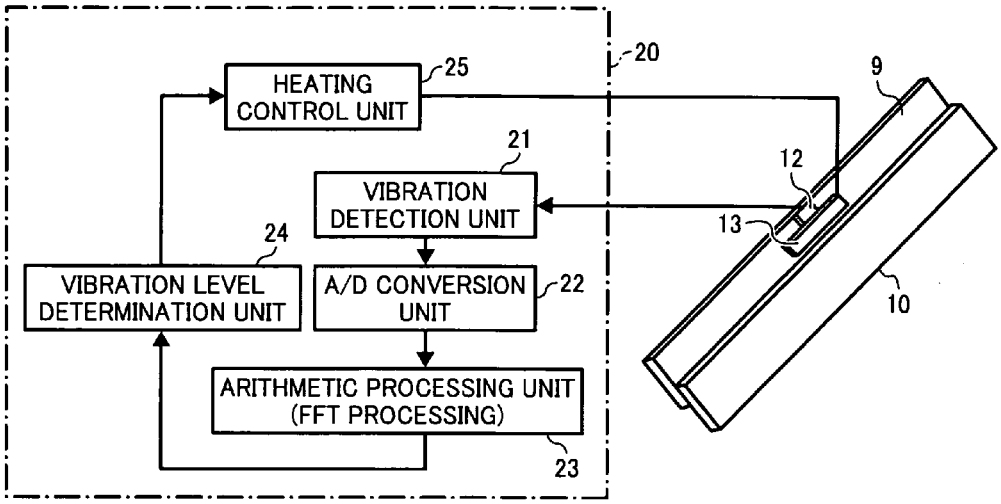
FIG. 5 is a diagram for explaining a control device for controlling a heating device of FIG. 4.

Further, FIG. 5 is a diagram for explaining a control device for controlling the heating device 13 of FIG. 4. In FIG. 5, a control device 20 is constituted by a vibration detection unit 21, an A/D (Analog-to-Digital) conversion unit 22, an arithmetic processing unit 23, a vibration level determination unit 24, and a heating control unit 25. In the control device 20, vibrations detected by the vibration detection device 12 provided to the holder 9 are transmitted to the vibration detection unit 21. The vibration detection unit 21 chronologically outputs the intensities (the accelerations) of the vibrations as analog signals. The output intensities of the vibrations are converted into digital signals by the A/D conversion unit 22. The digital signals are subjected to arithmetic processing by the arithmetic processing unit 23 and transmitted to the vibration level determination unit 24 as the frequencies and the intensities of the vibrations. The vibration level determination unit 24 determines whether or not the vibration level detected by the vibration detection device 12 has exceeded a set threshold value. If the detected vibration level has exceeded the threshold value, the heating control unit 25 causes the heating device 13 to heat the holder 9 by controlling the heating device 13 in accordance with the degree by which the detected vibration level has exceeded the threshold value.

As the holder 9 is heated upon exceeding of the set threshold value by the vibration level detected by the vibration detection device 12, the rigidity of the blade member 10 is changed to cause a slight change in the contact sliding state. Accordingly, the self-excited vibration is prevented, and the noise caused by the vibration can be reduced.

In the configuration of the present example, the vibration detection device 12 and the heating device 13 are provided to the holder 9 for holding the blade member 10. Alternatively, the vibration detection device 12 and the heating device 13 may be directly provided to the blade member 10 to detect the vibration of the blade member 10 and directly heat the blade member 10.

Further, the heating device 13 described above may be replaced by a cooling device capable of cooling the blade member 10 or the holder 9 so that the blade member 10 or the holder 9 is cooled according to the control by a control device when the vibration level detected by the vibration detection device 12 exceeds a set threshold value. As the blade member 10 or the holder 9 is cooled, the rigidity of the blade member 10 is changed to cause a slight change in the contact sliding state. Accordingly, the self-excited vibration is prevented, and the noise caused by the vibration can be reduced.

As the heating device 13 or the cooling device, a Pettier element can be used. The Peltier element is a plate-like semiconductor device using the Peltier effect, i.e., the phenomenon in which, when current is applied to the junction of two types of metals, the heat is transferred from one of the metals to the other metal. If direct current is applied to the Peltier element, the Peltier element absorbs the heat from a surface thereof and emits the heat from the other surface thereof. With this characteristic, the blade member 10 or the holder 9 can be easily heated or cooled.

Further, the Peltier element can switch between heating and cooling in accordance with a change in current polarity, and thus can flexibly change the temperature of the blade member 10 to a temperature for reducing the vibration noise.

Further, the Peltier element is small-sized and low power, and can be provided on the blade member 10 or the holder 9 by pasting or the like. With this characteristic, the Peltier element can directly heat or cool the blade member 10 or the holder 9. Thus, the rigidity of the blade member 10 can be immediately changed to cause a change in the contact sliding state between the blade member 10 and the image carrying member 1. Accordingly, the occurring self-excited vibration is reduced, and the vibration noise can be reduced.

In FIG. 4, the vibration detection device 12 capable of detecting the vibration state can be formed by a piezoelectric element. The piezoelectric element has a characteristic of generating a voltage when applied with pressure and conversely changing the shape thereof when applied with a voltage. Upon generation of vibration, therefore, the piezoelectric element is applied with pressure and generates a voltage according to the pressure. Thus, the vibration state can be detected by the measurement of the generated voltage. Further, the piezoelectric element can be formed into an arbitrary thickness and size, and is not significantly limited in the installation location thereof on the blade member 10. As the method of installing the vibration detection device 12, any method can be employed as long as the method allows the application of vibration such as bending to the holder 9 or the blade member 10. The vibration detection device 12 can be installed with the use of an adhesive agent formed of an epoxy resin and so forth. Further, the installation position of the vibration detection device 12 is not limited as long as the vibration detection device 12 can detect the occurrence of the stick-slip at the position.

If the vibration detection device 12 is formed by the piezoelectric element, therefore, the vibration detection device 12 can be set on a member such as the blade member 10 with no need for a large space. Further, the occurring vibration can be quantitatively measured.

Figure 6:
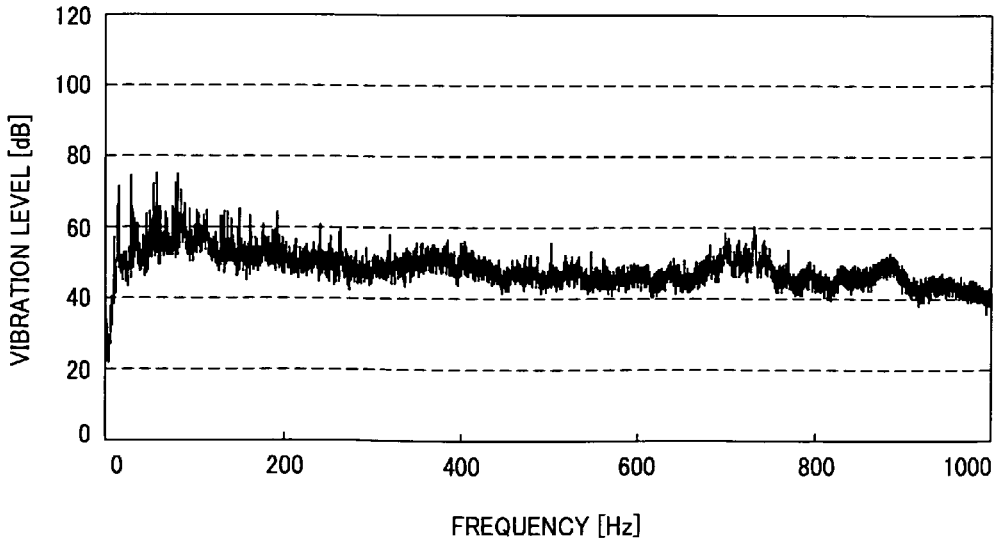
FIG. 6 is a graph illustrating a vibration state obtained when a blade member is cooled in the noise-occurring state of FIG. 3.

FIG. 6 is a graph illustrating a vibration state obtained when the blade member 10 is cooled in the noise-occurring state of FIG. 3. As illustrated in FIG. 6, it is observed that the large vibration generated at the frequency of 715 hertz in FIG. 3 and causing the noise has been reduced, and that the noise has disappeared.

Figure 7:
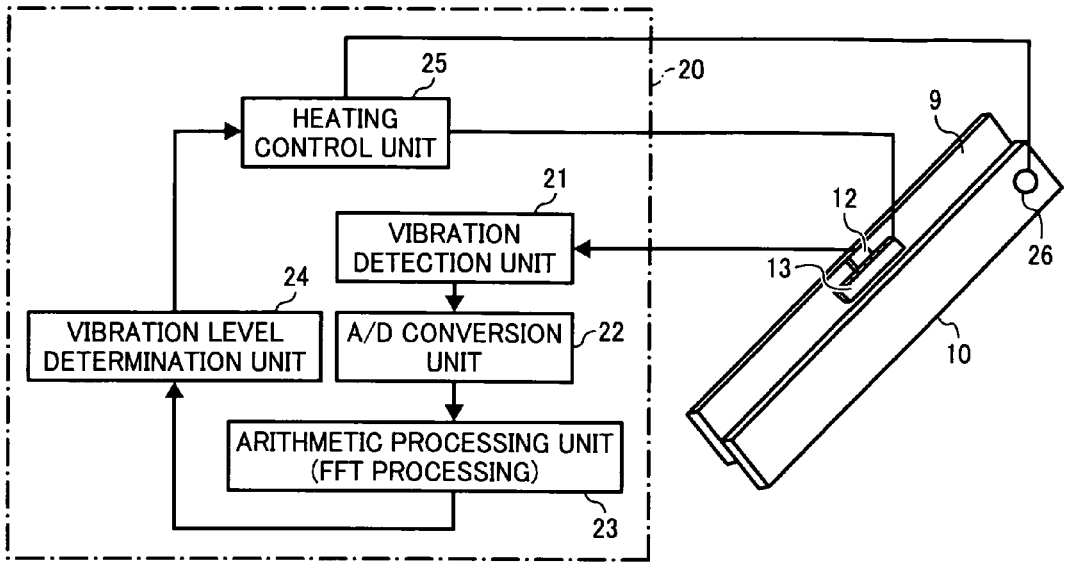
FIG. 7 is a schematic diagram illustrating the configuration of FIG. 5 added with a temperature measuring device capable of monitoring the temperature of the blade member.

FIG. 7 is a schematic diagram illustrating the configuration of FIG. 5 added with a temperature measuring device 26 capable of monitoring the temperature of the blade member 10. In the control performed by the control device 20, which is substantially similar to the control illustrated in FIG. 5, the temperature of the blade member 10 is measured by the temperature measuring device 26 provided to the blade member 10, and the result of the measurement is used in the control performed by the heating control unit 25. With this configuration, the deterioration of the blade member 10 due to overheating can be prevented. Further, the contact sliding state between the blade member 10 and the image carrying member 1 is changed while the rigidity of the blade member 10, which is changed according to the environmental change such as the increase in the internal temperature of the apparatus, is normalized. Accordingly, the cleaning failure can be prevented. Further, the occurring self-excited vibration is reduced, and the vibration noise can be reduced.

Further, as described above, the Peltier element has the characteristic of reversing the relationship between the heat absorption and the heat emission upon reversal of the current polarity. Therefore, if the Peltier element is used as the heating device 13 or the cooling device, it is possible to control the temperature of the blade member 10 by controlling the current to switch between heating and cooling. With this control, the contact sliding state can be changed. Accordingly, it is possible to reduce the vibration and thus reduce the squeaky noise.

Figure 8:
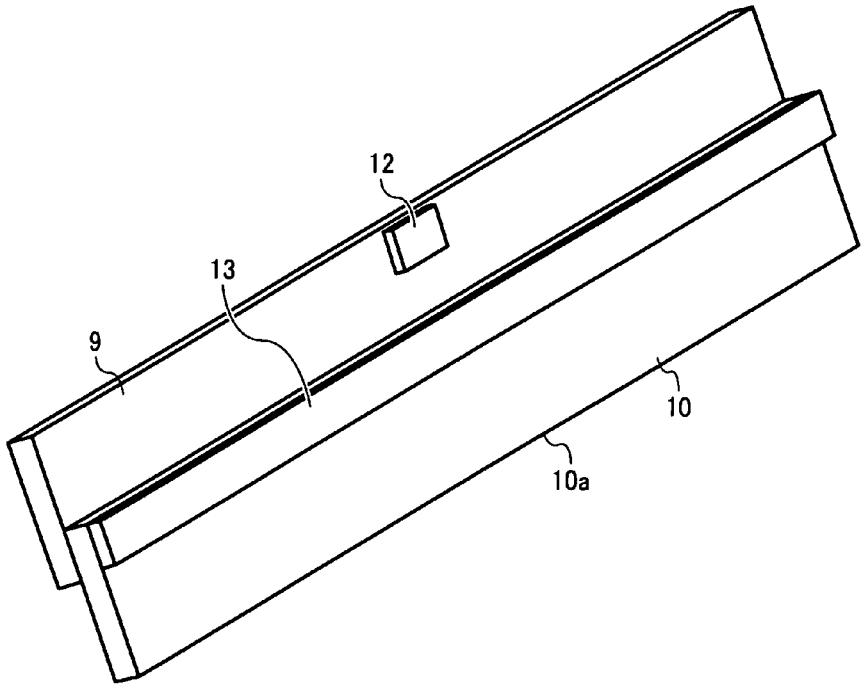
FIG. 8 is a diagram illustrating a configuration including a heating device or a cooling device provided over the entire length of the blade member in the longitudinal direction.

FIG. 8 is a diagram illustrating a configuration including the heating device 13 or the cooling device provided over the entire length of the blade member 10 in the longitudinal direction. As illustrated in FIG. 8, with the heating device 13 or the cooling device provided over the entire length of the blade member 10 in the longitudinal direction, the blade member 10 and the contact end 10*a* can be uniformly heated or cooled. It is therefore possible to obtain an effect of preventing the cleaning failure occurring when the contact state becomes unstable due to the change in the physical property value caused by partial heating or cooling.

Subsequently, description will be made of a process cartridge configured to integrate the cleaning device 6 according to the embodiment of the present invention with the image carrying member 1, the charging device 2, and the development device 4, and to be attachable to and detachable from the body of an image forming apparatus such as a copier and a printer.

Figure 9:
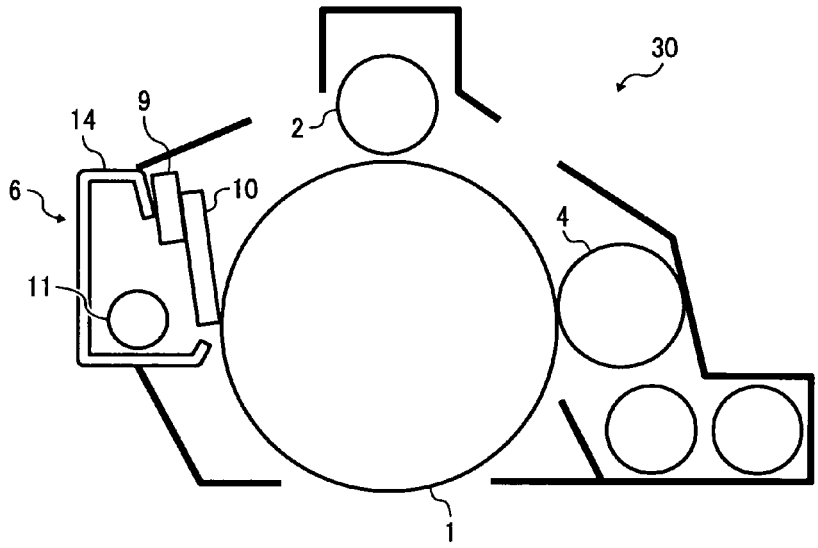
FIG. 9 is a cross-sectional view of a schematic configuration of a process cartridge including a cleaning device according to an embodiment of the present invention.

FIG. 9 is a cross-sectional view of a schematic configuration of a process cartridge 30 including the cleaning device 6 according to the embodiment of the present invention. With the cleaning device 6 according to the embodiment of the present invention provided in the attachable and detachable process cartridge 30, the noise occurring in the cleaning process is reduced. Further, the maintenance performance is improved, and the replacement of the cleaning device 6 integrally with the other devices can be easily performed.

Subsequently, description will be made of the application of the present invention to an embodiment in which the process cartridge 30 including the cleaning device 6 according to the embodiment of the present invention is used in a color image forming apparatus.

Figure 10:
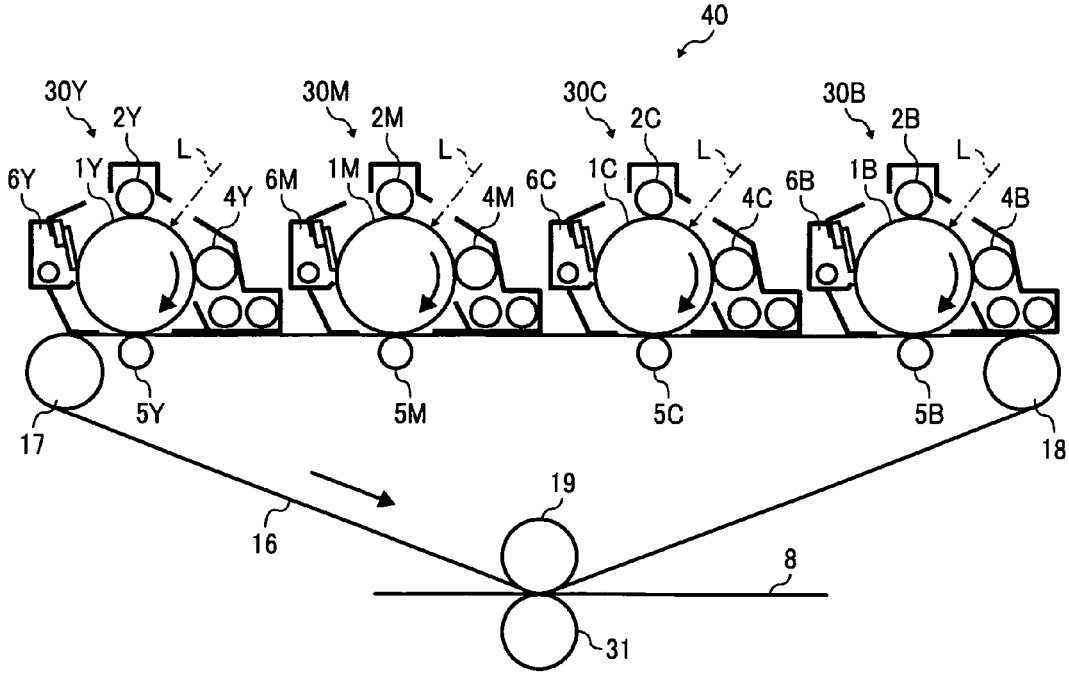
FIG. 10 is a diagram illustrating a type of color image forming apparatus including a plurality of juxtaposed process cartridges according to an embodiment of the present invention.

FIG. 10 is a diagram illustrating a color image forming apparatus 40 including a plurality of the juxtaposed process cartridges 30 according to the embodiment of the present invention. In FIG. 10, four process cartridges 30 according to the embodiment of the present invention, i.e., process cartridges 30Y, 30M, 30C, and 30B corresponding to colors of yellow (Y), magenta (M), cyan (C), and block (B), respectively, are arranged along a transfer belt 16 stretched over rollers 17, 18, and 19 and conveyed in the direction indicated by an arrow.

In the process cartridges 30Y, 30M, 30C, and 30B, a light flux L is applied to image carrying members 1Y, 1M, 1C, and 1B, respectively, to form electrostatic latent images. The electrostatic latent images are supplied with toner by development devices 4Y, 4M, 4C, and 4B, respectively, to form developed toner images. The developed toner images are sequentially transferred onto the transfer belt 16, which horizontally extends and is applied with a transfer voltage, by transfer devices 5Y, 5M, 5C, and 5B, respectively.

In the above-described manner, the images of the yellow, magenta, cyan, and black colors are formed. The developed toner images multiply transferred on the transfer belt 16 are transferred together onto the transfer medium 8 by a second transfer device 31. Then, the multiple toner images formed on the transfer medium 8 are fixed thereon by a not-illustrated fixing device. In the above description, the process cartridges 30 are arranged in the order of yellow, magenta, cyan, and black. However, the arrangement is not limited to the above order. Thus, the process cartridges 30 may be juxtaposed in any order.

Normally, a color image forming apparatus includes a plurality of image forming units, and thus is increased in size. Further, if a failure individually occurs in each of units such as a cleaning unit and a charging unit, or if the unit has reached the replacement time due to the expiration of the life thereof, the replacement of the unit takes substantial time and effort due to the complexity of the apparatus. In view of this, the respective components of an image carrying member, a charging device, and a development device are integrated together as a process cartridge, as in the present embodiment. With this configuration, it is possible to provide a small-sized and highly durable color image forming apparatus enabling the replacement of the units by a user. It is also possible to provide a color image forming apparatus which reduces the noise caused by the cleaning process and improves the maintenance performance in the replacement of the process cartridge.

What is claimed is:

1. A cleaning device comprising:

a blade member for coming into contact with an image carrying member and cleaning off toner remaining on the image carrying member;

a holder for holding the blade member;

a vibration detection device for detecting the vibration level of either one of the blade member and the holder;

a heating device for heating either one of the blade member and the holder; and a control device for controlling the heating device to heat either one of the blade member and the holder when the vibration level detected by the vibration detection device exceeds a predetermined threshold value.

2. The cleaning device as described in claim 1, wherein the vibration detection device includes a piezoelectric element.

3. The cleaning device as described in claim 1, wherein the heating device includes a Peltier element.

4. The cleaning device as described in claim 1, further comprising:

a temperature measuring device for measuring the temperature of the blade member.

5. The cleaning device as described in claim 1, wherein the heating device is provided over the entire length of the blade member in the longitudinal direction.

6. An image forming apparatus comprising the cleaning device as described in claim 1.

7. A process cartridge comprising the cleaning device as described in claim 1.

8. An image forming apparatus comprising at least two or more process cartridges each as described in claim 7.

* * * * *